US011859262B2

(12) United States Patent
Huang et al.

(10) Patent No.: US 11,859,262 B2
(45) Date of Patent: Jan. 2, 2024

(54) LARGE-SIZED HIGH-NB SUPERALLOY INGOT AND SMELTING PROCESS THEREOF

(71) Applicants: Gaona Aero Material Co., Ltd., Beijing (CN); Fushun Special Steel Shares Co., Ltd., Liaoning (CN)

(72) Inventors: Shuo Huang, Beijing (CN); Guangpu Zhao, Beijing (CN); Beijiang Zhang, Beijing (CN); Ran Duan, Beijing (CN); Heyong Qin, Beijing (CN); Lianpeng Li, Liaoning (CN); Yingyu Chou, Liaoning (CN); Chao Qi, Liaoning (CN)

(73) Assignees: Gaona Aero Material Co., Ltd., Beijing (CN); Fushun Special Steel Shares Co., Ltd., Liaoning (CN)

( * ) Notice: Subject to any disclaimer, the term of this patent is extended or adjusted under 35 U.S.C. 154(b) by 719 days.

(21) Appl. No.: 17/033,959

(22) Filed: Sep. 28, 2020

(65) Prior Publication Data

US 2021/0062292 A1 Mar. 4, 2021

Related U.S. Application Data

(63) Continuation of application No. PCT/CN2020/078718, filed on Mar. 11, 2020.

(30) Foreign Application Priority Data

Aug. 28, 2019 (CN) ..... 201910803960.4

(51) Int. Cl.

| | |
|---|---|
| ***C21D 9/70*** | (2006.01) |
| ***C22B 9/20*** | (2006.01) |
| ***C22B 9/18*** | (2006.01) |
| ***C22C 27/02*** | (2006.01) |

(52) U.S. Cl.

CPC ..... *C21D 9/70* (2013.01); *C22B 9/18* (2013.01); *C22B 9/20* (2013.01); *C22C 27/02* (2013.01)

(58) Field of Classification Search

None

See application file for complete search history.

(56) References Cited

U.S. PATENT DOCUMENTS

| | | | | |
|---|---|---|---|---|
| 2002/0170386 | A1 | 11/2002 | Bond et al. | |
| 2006/0075624 | A1 | 4/2006 | Seth | |
| 2016/0376685 | A1* | 12/2016 | Banik | C22B 9/20 75/10.14 |
| 2021/0062292 | A1* | 3/2021 | Huang | C22B 9/04 |

FOREIGN PATENT DOCUMENTS

| | | | |
|---|---|---|---|
| CN | 1165205 | | 11/1997 |
| CN | 1503850 | | 6/2004 |
| CN | 106676299 | | 5/2017 |
| CN | 107750280 | | 3/2018 |
| DE | 102018009375 | | 6/2019 |
| EP | 2039789 | A1 | 3/2009 |
| EP | 2314725 | A1 | 4/2011 |
| EP | 2835434 | A2 | 2/2015 |
| EP | 3109331 | A1 | 12/2016 |
| EP | 3325680 | A1 | 5/2018 |
| WO | 2013089218 | | 6/2013 |
| WO | 2016209591 | A1 | 12/2016 |

OTHER PUBLICATIONS

Office Action of China Counterpart Application, dated Apr. 2, 2021, pp. 1-7.

H Scholz, et al., "ESR Meets the Requirements for Big Forgings." Iron and Steel, vol. 48, No. 10, Oct. 2013, pp. 1-6.

"International Search Report (Form PCT/ISA/210)" of PCT/CN2020/078718, dated Jun. 5, 2020, pp. 1-6.

European Patent Office; Extended European Search Report of Corresponding Application No. 20771183.9; 13 Pgs, dated Aug. 18, 2023.

Alok Choudhury; XP0006000856; "State of the Art of Superalloy Production for Aerospance and Other Application Using VIM/VAR or VIM/ESR"; May 1992; ISIJ International, vol. 32 (1992). No. 5, pp. 563-574; 12 Pgs.

* cited by examiner

*Primary Examiner* — Scott R Kastler

(74) *Attorney, Agent, or Firm* — COOPER LEGAL GROUP, LLC

(57) ABSTRACT

Disclosed in this application are a large-sized high-Nb superalloy ingot and a smelting process thereof. The smelting process includes: vacuum induction melting to prepare a plurality of vacuum induction melting ingots with the same composition which are used for preparing electroslag electrodes with the same number as the vacuum induction melting ingots for use in electroslag remelting, preparing a consumable electrode from the prepared consumable electroslag electrodes, and performing vacuum consumable arc remelting for a plurality of times by using the consumable electroslag electrodes as raw material. A large-sized high-Nb superalloy ingot having a weight of 15 tons or above and a diameter of 800 mm or above can be prepared from such process.

6 Claims, No Drawings

LARGE-SIZED HIGH-NB SUPERALLOY INGOT AND SMELTING PROCESS THEREOF

CROSS-REFERENCE TO RELATED APPLICATION

The present application is a continuation of international application of PCT application serial No. PCT/CN2020/078718 filed on Mar. 11, 2020, which claims the priority benefit of China application No. 201910803960.4 filed on Aug. 28, 2019. The entirety of each of the above-mentioned patent applications is incorporated herein by reference and made a part of this specification.

BACKGROUND

Technical Field

This application relates to a technical field of a large-sized high-Nb superalloy ingot, and more particularly, to a large-sized high-Nb superalloy ingot and a smelting process thereof.

Description of Related Art

With the improvement of a thermal efficiency and the increase of power of a gas turbine, a turbine disk of an advanced heavy-duty gas turbine with the power greater than 200 MW gradually upgrades from alloy steel to superalloy regarding its material. Compared with the alloy steel, a yield strength of the superalloy at 500° C. is increased by 40% or above, and a creep rupture strength at 550° C. after 100000 h is increased by 300% or above. It can significantly improve the strength of the disk of the heavy-duty gas turbine at high temperature and after long time, which is advantageous to simplify the structure and improves reliability and thermal efficiency of the gas turbine.

The size of the disk of the heavy-duty gas turbine generally exceeds 2000 mm, which requires a forged piece having a weight above 10 tons, and an ingot having a weight above 15 tons. The turbine disc as prepared should reliably service for more than 100,000 h in a service environment, which puts forward high requirements on metallurgical quality of the ingot.

For Alloy 706 and Alloy 718 containing more than 3% of Nb, a triple-melt process including steps of "vacuum induction melting (VIM)+electroslag remelting (ESR)+consumable vacuum arc remelting (VAR)" is generally adopted to produce a large superalloy ingot case having a weight of 10 tons or above in Europe and United States. For example, US patent publication No. US 20020170386A1 discloses the triple-melt process of the large ingot case made of Alloy 718 and any alloys having diameters greater than 762 mm. During the triple-melt process, the ingot case needs to accommodate an electrode having a given diameter, and this patent gives several examples of the ingot case and the electrode accommodating each other.

For a superalloy VAR ingot having a weight greater than 15 tons, taking into account the loss during the triple-melt process (polishing the electrode and cutting a head and a tail of the electrode), the weight of a VIM ingot should exceed 20 tons, which puts forward higher requirement on the equipment of a VIM furnace and an ESR furnace. At present, a main technical bottleneck of producing the large superalloy ingot case having a weight of 15 tons or above in China is that there is no VIM equipment having a nominal capacity greater than 20 tons, therefore it is impossible to prepare single VIM billet having a weight of 20 tons or above. In order to solve this problem and accommodate to the equipment in China, the VIM furnace can only be used to cast two VIM ingots having the weight of 10 tons for each, and during two-arm ESR, two short electrodes having small-tonnage are used to prepare a superalloy electroslag ingot having large-tonnage which is then used in subsequent VAR.

Due to the high degree of alloying, alloys such as Alloy 706 and Alloy 718 are very sensitive to smelting parameters of VAR, and metallurgical defects such as experiencing black and white freckles can be created easily due to the fluctuation of parameters, therefore stable smelting parameters of VAR are required. In addition, using the two-arm ESR method to prepare a large-sized ESR ingot is likely to form a series of quality defects such as injection, overflow of molten steel, fluctuation of composition and inclusion during exchanging the electrode, which cannot be completely eliminated even by subsequent diffusion annealing at high temperature and electrode forging. In the subsequent VAR process, when smelting till the electrode joint, the above quality defects will cause the fluctuation of the smelting parameters, thereby affecting the metallurgical quality of the VAR ingot.

SUMMARY

In a first aspect, this application provides a smelting process of a large-sized high-Nb superalloy ingot which can effectively solve the problem of black and white freckles formed by increased segregation due to the enlargement of the diameter or weight of the large-sized high-Nb superalloy ingots, the cracking of the steel ingot caused by large thermal stress, and the problem that the weight of the steel ingot cannot be increased due to the limitation of the tonnage of an electrode arm of ESR equipment, so that it can realize the preparation of the large-sized high-Nb superalloy ingot with the weight of 15 tons or above and the diameter of 800 mm or above, while preventing the generation of black and white freckles to the outermost, reducing the degree of element segregation, and effectively preventing the steel ingot from cracking.

In a second aspect, this application provides a large-sized high-Nb superalloy ingot having a weight of at least 15 tons and free from hot-cracking, black and white freckles, or burning loss of Al and Ti. Upon non-destructive examination, it is found that there is no abnormal signal at the site where the electroslag is remelted in bars forged from such ingots.

In one embodiment, this application provides the following technical solution: a smelting process of a large-sized high-Nb superalloy ingot including the following steps: vacuum induction melting (VIM): conducting VIM on pure metal raw material and/or recycled material as raw material, and pouring to form a plurality of VIM ingots with the same composition; electroslag remelting (ESR): preparing the same number of electroslag electrodes as that of the prepared VIM ingots; and electroslag remelting all the prepared electroslag electrodes under protection of argon, followed by cooling down and demoulding to obtain an ESR ingot; and conducting consumable vacuum arc remelting (VAR) for a plurality of times: performing a first annealing and a second annealing to the obtained ESR ingot and forging by stretching to a predetermined size to obtain a primary consumable electrode, in which the second annealing is performed at a temperature higher than that for the first annealing temperature; and performing VAR for at least twice by using the primary consumable electrode as starting material, in which, a resulting VAR ingot obtained after each VAR is used as a consumable electrode to be used in a next VAR, with a diameter of the resulting VAR ingot being increased after each VAR until fluctuation of a melting rate during a last VAR fall within ±10% of a steady-state melting rate, and a VAR ingot obtained in the last VAR is used to prepare an ingot with a target diameter.

In the above technical solution, for addressing the problem of insufficient capacity of VIM equipment, a VIM furnace with a conventional tonnage (such as 12 tons) is used to prepare a plurality of VIM ingots with the same composition (which also reduces the requirement for the weight of single VIM ingot), thereby preparing a plurality of electroslag electrodes, and then ESR is carried out to prepare the ESR ingot with higher tonnage, which is then subjected to VAR for a plurality of times. In this way, the first VAR can improve the smelting quality of the site where the electrode is exchanged, and the second or more VAR can thoroughly addressing the quality defects suffered during smelting, so as to prepare the consumable large-sized superalloy ingot with the weight of at least 15 tons which is of premium quality and free from metallurgical detects. In view of the loss, the total weight of a plurality of VIM ingots should be 125% to 160% of the desired weight of the ingot.

In a preferred embodiment, in the step of VIM, the raw material contains 2.8-5.5wt % Nb, 0.2-1.0 wt % Al and 0.5-2.0 wt % Ti.

In a preferred embodiment, in the step of VIM, the raw material is melt at a temperature of 1400-1550° C. until melting down, refined under electromagnetic stirring at 1350-1550° C. for 15-120 min, cooled for 1-10 h, and demoulded to obtain the VIM ingot; and the VIM process is performed for a plurality of times to obtain a plurality of VIM ingots with the same composition.

In fact, when a single VIM ingot has the diameter greater than 800 mm and the weight greater than 10 tons, high thermal stress will be generated in the large-sized high-Nb superalloy VIM ingot during solidification after casting. This is especially true for an age precipitated alloy containing Al and Ti, in which the strengthened phase will be precipitated after cooling to a temperature within an aging precipitation temperature range of a strengthened phase, which will generate greater structural stress, or in severer situation, cause the steel ingot to crack directly. However, too short demoulding time will lead to uncomplete solidification of the steel ingot, which is prone to cracking due to earlier demoulding.

In view of this, in a preferred embodiment, the electroslag electrode is prepared as follows: directly stress-relieve annealing each VIM ingot, in which the temperature is initially raised to 600-800° C., then raised to 800-1000° C. at a rate of 5-45° C./h, kept constant for 4-32h, lowered to 600-800° C. at a rate of 1-35° C./h and kept constant for 4-32 h; air cooling; polishing; and flattening at the head and the tail to obtain the electroslag electrode. Generally, a diameter of the obtained electroslag electrode should match a diameter of a matching crystallizer of the VAR furnace used in the VAR step, that is, ratio of the diameter of a matching crystallizer to the diameter of the electrode, i.e., a filling ratio, should be a proper range, i.e. about 0.8-0.9.

In the above technical solution, directly stress-relieve annealing VIM ingots provides the following advantages: firstly, it can timely prevent the generation of extremely large structural stress in the steel ingot after demoulding due to the temperature falling into the range of the aging precipitation during air cooling; secondly, the steel ingot can be heated at the reasonable rate, which can avoid the generation of high thermal stress between the inside and outside of the steel ingot which, otherwise, would be generated due to low thermal conductivity of a superalloy; thirdly, keeping the temperature at 800-1000° C. for a certain time can thoroughly and evenly heat the steel ingot so as to release internal stress during solidification; and fourthly, slowly cooling down at the rate of 1-35° C./h and keeping the temperature constant at 600-800° C. for a certain time can effectively prevent the regeneration of high thermal stress and structural stress in the steel ingot.

In a preferred embodiment, during ESR, a quaternary slag system ($CaF_2$—$CaO$—$Al_2O_3$—$TiO_2$) including 60-75 wt % $CaF_2$, 10-25 wt % CaO, 10-25 wt % $Al_2O_3$, and 1-10 wt % $TiO_2$ is adopted; a steady-state melting rate of ESR is controlled to be 5-15 kg/min, and before exchanging each electrode, when the remaining weight of one electrode is 500 kg-1000 kg, the melting rate is increased by a slope of 0.5-2 kg/min to 12-25 kg/min on the basis of the steady-state melting rate and kept stable until the electrode exchanging begins, during which the smelting parameters remain the same as those before the exchanging and the exchanging time does not exceed 2 min; after exchanging each electrode, the melting rate is reduced by a slope of 0.5-2 kg/min to a steady-state melting rate of 5-15 kg/min for continuing the remelting when 100 kg-500 kg of a next electrode is melted, and hot topping is carried out when the remaining weight of a last electrode is 200-600 kg; and after ESR, cooling down is carried out for 2-10 h and demoulding is carried out to obtain the ESR ingot.

By adopting the above technical solution, the content of $TiO_2$ in the electroslag can be controlled to be 1-10 wt %, which can solve the problem of burning loss of Ti at the head and tail of the ESR ingot. For ingot cases having a diameter greater than 1000 mm, the steady-state melting rate during ESR is controlled to be 5-15 kg/min, and the melting rates before and after exchanging the electrode are adjusted, so that the depth of a molten bath during exchanging the electrode can be reasonably increased, which can solve the problem of reduced fluidity of the molten bath caused by the suspension of smelting during exchanging the electrode, reduce the disturbance to the molten bath caused by the instantaneous embedding of the electrode into the slag bath, and reduce metallurgical quality defects due to inclusion, continued pouring, etc.

In a preferred embodiment, in the step of VAR for a plurality of times, performing the first annealing and the second annealing on the obtained ESR ingot and forging by stretching to a predetermined size to obtain the primary consumable electrode includes the following steps of:

initiating the first annealing to the ESR ingot within 0.5-2 h after demoulding, in which the temperature is initially raised to 300-550° C., kept constant for 12-32 h for achieving homogeneous temperature distribution, raised to 600-750° C. at a rate of 1-25° C./h, kept constant for 4-32 h, raised to 800-1000° C. at a rate of 5-35° C./h, kept constant for 4-32 h, lowered to 550-750° C. at a rate of 1-35° C./h, and kept constant for 4-32 h, followed by air cooling;

performing the second annealing on the ESR ingot after the first annealing, in which the temperature is kept constant at 550-750° C. for 4-24 h, raised to 800-1000° C. at a rate of 5-35° C./h, raised to 1050-1150° C. at a rate of 1-25° C./h, kept constant for 4-32 h, raised to 1150-1250° C. at a rate of 1-25° C./h, kept constant for 24-72 h, lowered to 800-950° C. at a rate of 1-35° C./h, and kept constant for 4-32 h, followed by air cooling;

forging the ESR ingots after the second annealing, in which the ESR ingot is heated to 1100-1180° C. for 4-12 h before forging, and subjected to free forging on a high-speed forging press of 3000 tons or above by stretching in one direction, in which a reduction per pass in one direction is 5-30 mm and a final forging temperature is in a range of 850-1000° C.; and polishing the ingots stretched during free forging and flattening at the head and the tail to obtain the primary consumable electrode. Generally, a diameter of the obtained primary consumable electrode should match the diameter of the matching crystallizer of the VAR furnace used in the first VAR.

The reason for adopting the above technical solution lies in that, for the obtained high-Nb superalloy ESR ingot with a diameter of 1000 mm or above, the thermal stress during solidification is extremely high, therefore the ESR ingot is very prone to cracking; since the ratio of the diameter of the primary consumable electrode and that of the corresponding crystallizer, that is, the filling ratio, should be a reasonable range, the large-sized ESR ingot cannot be directly used for the first VAR, and thus the free forging is required for reducing the diameter to, for example, 800-900 mm; and as the diameter of the ESR ingot is very large, a segregation during solidification and, in turn, dendrite segregation and low-melting-point phases between dendrites will significant, leading to extremely poor thermoplasticity.

To solve the problem that the high-Nb superalloy ESR ingot with the diameter of 1000 mm or above has high thermal stress, in this application, a water-cooled crystallizer in the ESR furnace is used after ESR for cooling for 2-10 h such that the steel ingot is thoroughly solidified and cooled to a temperature below the aging precipitation temperature, and the first annealing is initiated within 0.5-2 h after demoulding. During the first annealing, the temperature is initially raised to 300-550° C. so as to avoid extremely high thermal stress caused by high temperature, and then kept at 300-550° C. for 12-32 h so as to achieve homogeneous temperature distribution. Then the temperature is raised to 600-750° C. at a rate of 1-25° C./h, kept constant for 4-32 h, raised to 800-1000° C. at a rate of 5-35° C./h, kept constant for 4-32 h, lowered to 550-750° C. at a rate of 1-35° C./h, and kept constant for 4-32 h, followed by air cooling. By means of the first annealing, the thermal stress generated by a temperature gradient during the solidification of the electroslag ingot can be released, and at the same time, the generation of a structural stress can be avoided by using an over-aging treatment to coarsen the strengthened phase, thereby preventing direct cracking of the large-sized superalloy ESR ingot after demoulding.

For the purpose of improving the thermoplasticity of high-Nb superalloy ESR ingot with a diameter of 800 mm or above, a second annealing, that is, a diffusion annealing at high temperature should be performed to the ESR ingot after the first annealing. In order to avoid extremely high thermal stress, the heating rate should be strictly controlled. Therefore, the ESR ingot is loaded into the furnace at the temperature of 550-750° C. or below and held at the temperature for 4-24 h, heated to 800-1000° C. at a rate of 5-35° C./h, heated to 1050-1150° C. at a rate of 1-25° C./h and held at the temperature for 4-32 h, heated to 1150-1250° C. at a rate of 1-25° C./h and held at the temperature for 24-72 h, and cooled to 800-950° C. at a rate of 1-35° C./h and held at the temperature for 4-32 h, following by air cooling. By adopting a multi-stage slow heating, the generation of extremely high thermal stress in the ingots and cracking thus brought about can be prevented. In addition, the high-temperature and long-time diffusion annealing can re-dissolve the low-melting-point phases in the alloy and alleviate dendrite segregation, thereby improving the thermoplasticity of the steel ingot and providing a steel ingot with high thermoplasticity for preparing consumable electrodes used in subsequent forging process.

In a preferred embodiment, in the step of VAR for a plurality of times, a first VAR and a second VAR includes the following steps:

performing the first VAR at a steady-state melting rate of 3.5-7.5 kg/min; initiating helium cooling when 800-2000 kg of the primary consumable electrode is melted; decreasing a current and adjusting the melting rate to 3.0-7.0 kg/min when the weight of the remained primary consumable electrode is 1500-5000 kg; and starting hot topping when the weight of the remained primary consumable electrode is 200-1000 kg, thereby obtaining a first VAR ingot;

for the second VAR, first polishing the first VAR ingot, and flattening the first VAR ingot at the head and the tail to obtain a secondary consumable electrode with a diameter matched with a diameter of a crystallizer used in the second VAR;

performing the second VAR at a steady-state melting rate of 4.0-8.5 kg/min; initiating helium cooling when 1000-3000 kg of the secondary consumable electrode is melted; decreasing the current and adjusting the melting rate to 3.0-7.5 kg/min when the weight of the remained secondary consumable electrode is 2000-5500 kg; and starting hot topping when the weight of the remained secondary consumable electrode is 250-1500 kg; and after the second VAR, vacuum cooling for 1-8 h and then starting stress-relief annealing within 2 h in which the temperature is raised to 300-750° C., kept constant for 4-32 h for achieving homogeneous temperature distribution, raised to 800-1000° C. at a rate of 5-50° C./h, kept constant for 4-32 h, lowered to 550-750° C. at a rate of 1-35° C./h, and kept constant for 4-32 h, followed by air cooling.

In the process of the first VAR, the volume of the ingot will be reduced during solidification, and there will be a gap between the ingot and the crystallizer, such that the steel ingot cannot directly contact an outer wall of the crystallizer under vacuum to achieve heat dissipation, therefore the helium is introduced for heat conduction. In the early stage of smelting, the steel ingot can dissipate heat to the crystallizer at the bottom, but heat dissipation through the bottom is limited when the smelting proceeds a certain stage, therefore it is necessary to introduce a proper amount of helium when the smelting reaches a certain stage. Too much helium will break the molten bath which impairs the stability of smelting, while too little helium will not provide sufficient cooling effect. Regarding an oversized ingot, the more the ingot solidifies, the greater the heat capacity is and the more difficult the heat conduction is. Therefore, at the late stage of smelting, it is necessary to appropriately reduce the melting rate and stabilize the depth of the molten bath, so as to reduce the probability of forming metallurgical defects. Judging the time for stating hot topping based on the weight of the remained primary consumable electrode can save the amount of the steel ingot to be removed and increase the yield.

In the process of the first VAR, as the primary consumable electrode is forged from the ESR ingot prepared by electroslag remelting of a plurality of VIM ingots, there will be fluctuation of smelting quality at the site where the electrode is exchanged, which cannot be thoroughly eliminated even by diffusion annealing at high temperature and forging. Since the VAR process is very sensitive to the quality of the electrode, it is likely to incur abnormal problems such as fluctuation of melting rate and mass collapse of the electrode when the smelting proceeds to the site where the electrode is exchanged, thereby forming metallurgical defects such as black and white freckles, which cannot be eliminated by subsequent diffusion annealing at high temperature, forging or heat treatment, and even cause direct scrapping of the bars or forged parts as prepared in severe situations. Therefore, in this application, the first VAR ingot is polished and flattened at the head and the tail for preparing a secondary consumable electrode for use in the second VAR. As large thermal stress will be generated in a steel ingot having a diameter greater than 800 mm after the second VAR, vacuum cooling is required after the second VAR and a stress-relief annealing is carried out within 2 h so as to prevent the steel ingot from cracking after demoulding, in which the temperature should be initially raised to 300-750° C., kept constant for 4-32 h for achieving homogeneous temperature distribution, raised to 800-1000° C. at a rate of 5-50° C./h, kept constant for 4-32 h, lowered to 550-750° C. at a rate of 1-35° C./h, and kept constant for 4-32 h, followed by air cooling. In this way, the thermal stress generated by the temperature gradient during the solidification of the electroslag ingot can be released, and at the same time, the generation of structural stress can be avoided by the coarsening of strengthened phase via over-aging treatment, thereby inhibiting direct cracking of the large-sized superalloy ESR ingot after demoulding.

In a preferred embodiment, if fluctuation of the melting rate during the second VAR is beyond ±10% of the steady-state melting rate, an obtained second VAR ingot is used to prepare a consumable electrode to be used for a next VAR by the same way as for preparing the primary consumable electrode, including the same first annealing, second annealing, and forging by stretching, and then the second VAR is repeated. Generally, a diameter of the obtained next consumable electrode should match a diameter of a matching crystallizer of the VAR furnace used in a next VAR.

In particular, the large-sized high-Nb superalloy ingot prepared by the above smelting process provided by the present application is an Alloy 706 with a diameter of 800 mm or above, which, by mass percentage, has a chemical composition of:

C≤0.02%, Cr 15.5-16.5%, Ni 40.0-43.0%, Nb 2.8-3.2%, Ti 1.5-1.8%, Al 0.1-0.3%, Si≤0.10%, Mn≤0.20%, P≤0.015%, S≤0.0013%, Co≤0.30%, Mo≤0.20%, B≤0.006%, Cu≤0.30%, Ca≤0.005%, N≤0.006%, O≤0.005%, and the balance Fe.

In particular, the large-sized high-Nb superalloy ingot prepared by the above smelting process provided by the present application is an Alloy 718 with a diameter of 800 mm or above, which, by mass percentage, has a chemical composition of:

C 0.005-0.04%, Cr 17.0-19.0%, Ni 52.0-55.0%, Nb 4.9-5.5%, Ti 0.75-1.15%, Al 0.35-0.65%, Si≤0.10%, Mn≤0.15%, P≤0.008%, S≤0.002%, Co≤0.50%, Mo 2.8-3.3%, B≤0.006%, Cu≤0.10%, Ca≤0.005%, N≤0.01%, O≤0.003%, and the balance Fe.

This application has the following advantages.

1. It can break through the limitation to the tonnage of VIM furnace and ESR furnace under atmosphere protection by preparing a plurality of electrodes by using VIM furnace with a conventional tonnage (such as 12 tons), then smelting a plurality of VIM ingots into one ESR ingot by exchanging the electrode in an ESR furnace, and using the same to prepare the VAR ingot having the weight of at least 15 tons.

2. It can prepare a superalloy ESR ingot having a weight of 20 tons by ESR by using the ESR furnace with limited electrode arm tonnage.

3. The smelting stability during the first VAR can be significantly improved by subjecting ESR ingot prepared by ESR to diffusion annealing at high temperature to improve the thermoplasticity, and preparing a consumable electrode with a suitable diameter by using free forging to stretch the billet.

4. The problem of metallurgical defects such as inclusion at the site where the electrode is exchanged during ESR can be effectively addressed by using the secondary consumable electrode prepared by the first VAR ingot for the second VAR, and, where necessary, performing VAR for a plurality of times, so that the high-niobium superalloy consumable ingot with a diameter of 800 mm or above and a weight greater than 15 tons and free from metallurgical defects can be prepared.

DESCRIPTION OF THE EMBODIMENTS

This application will be described in detail below in combination with examples.

EXAMPLE 1

This example is used to illustrate a method for preparing Alloy 706 (a VAR ingot with a diameter of 1050 mm).

The target Alloy 706 had a composition of (by mass percentage):

C 0.018%, Cr 15.8%, Ni 41.5%, Nb 3.01%, Ti 1.72%, Al 0.25%, Si 0.02%, Mn 0.01%, P 0.006%, S 0.0006%, Co 0.02%, Mo 0.01%, B 0.004%, Cu 0.02%, Ca 0.004%, N 0.005%, O 0.002%, and the balance Fe.

The specific method for preparing the alloy was as follow.

Vacuum induction melting (VIM): according to the requirements of composition of the designed alloy, recycled material accounting for 50% of the elements needed for alloy of unit weight, was weighed, and fresh metals accounting for the rest of the weight were weighed. A 12-ton VIM furnace was adopted, with an upper melting temperature limit being 1550° C. After melting down, the composition of molten steel was detected, and the molten steel was controlled to contain approximately 3.02 wt % Nb, approximately 1.80 wt % Ti, and approximately 0.30 wt % Al by adding fresh metals. According to the amount of the added fresh metal, refining was carried out under electromagnetic stirring at 1350° C. for 15-30 min, and tapping was conducted at a temperature of 1400° C. After pouring the molten steel, furnace cooling was carried out for 4 h and demoulding was carried out to obtain one VIM ingot with a diameter of 820 mm and a weight of 12 tons which was directly annealed. An annealing furnace was pre-heated to 600° C., heated to 800° C. at a rate of 5° C./h and held at the temperature for 24 h, cooled to 600° C. at a rate of 1° C./h and held at the temperature for 10 h, and then air-cooled.

The annealed VIM ingot was polished and flattened at the head and the tail to prepare an electroslag electrode.

Electroslag remelting (ESR): A crystallizer with a diameter of 1100 mm was adopted and a quaternary ($CaF_2$—CaO—$Al_2O_3$—TiO2) slag system specifically having a composition of, by weight, 60% $CaF_2$, 10% CaO, 25% $Al_2O_3$, and 10% TiO2 was adopted. A steady-state melting rate was 15 kg/min. During smelting, Ar at 0.2 bar pressure was introduced for protection, so as to prevent the molten steel from contacting with oxygen and nitrogen in the air. Before exchanging the electrode, when the weight of the remained first electrode was 800 kg, the melting rate was increased by 1.05 kg/min to 25 kg/min on the basis of the steady-state melting rate by adjusting input power and a voltage and was held until the electrode exchanging began. Smelting parameters during exchanging the electrode remained the same as those before exchanging the electrode, and the time for exchanging did not exceed 2 min. After exchanging the electrode, when 100 kg of a second electrode was melted, the melting rate was decreased by 0.50 kg/min to 10 kg/min by adjusting the input power and the voltage, and hot topping was carried out when the weight of the remained second electrode was 200 kg.

After ESR, an ESR ingot was water cooled in a water-cooled crystallizer in the furnace for 4 h, and within 0.5 h after demoulding, transferred to an annealing furnace for stress-relief annealing. The annealing furnace was pre-heated to 300° C. and held at the temperature for 12 h, heated to 600° C. at a rate of 5° C./h and held at the temperature for 4 h, heated to 800° C. at a rate of 5° C./h and held at the temperature for 5 h, cooled to 600° C. at a rate of 5° C./h and held at the temperature for 12 h, and then air-cooled.

Diffusion annealing ESR ingot at high temperature: The ESR ingot was loaded into the furnace at the temperature of 550° C. or below and held at the temperature for 4 h, heated to 800° C. at a rate of 10° C./h, heated to 1050° C. at the rate of 5° C./h and held at the temperature for 4 h, heated to 1150° C. at the rate of 5° C./h and held at the temperature for 24 h, cooled down to 800° C. at the rate of 5° C./h and held at the temperature for 32 h, and then air cooled.

Forging the electrode: The ESR ingot with a diameter of 1100 mm was heated to 1100° C. for 4 h before forging. A free forging was performed on a 3500-ton high-speed forging press by stretching the ingot in one direction, in which reduction per pass in one direction was controlled to be 25 mm, and the final forging temperature was 850° C. Finally, the ESR ingot was polished and flattened at the head and the tail to provide a primary consumable electrode with a diameter of 820 mm for use in a first VAR.

First VAR: A crystallizer with a diameter of 920 mm was adopted, the first VAR was controlled by the melting rate, and a steady-state melting rate was controlled to be 3.5 kg/min; helium cooling was initiated when 800 kg of the primary consumable electrode was melted; a current was reduced and the melting rate was adjusted to 3.0 kg/min when the weight of the remained primary consumable electrode was 1500 kg; and hot topping controlled by the current was initiated when the weight of the remained primary consumable electrode was 200 kg. The steel ingot was polished and flattened at the head and the tail to provide a first VAR ingot with a diameter of 900 mm for use in a second VAR.

Second VAR: A crystallizer with a diameter of 1050 mm was adopted, the second VAR was controlled by the melting rate, and a steady-state melting rate was controlled to be 4.0 kg/min;

helium cooling was initiated when 1000 kg of the first VAR ingot was melted; the current was reduced and the melting rate was adjusted to 3.0 kg/min when the weight of the remained first VAR ingot was 2000 kg; and hot topping controlled by the current was carried out when the weight of the remained first VAR ingot was 250 kg. After the second VAR, the steel ingot was vacuum-cooled for 3 h and transferred within 2 h to the annealing furnace for stress-relief annealing, which prevents the steel ingot from cracking after demoulding. The annealing furnace was pre-heated to 300° C. and held at the temperature for 4 h, heated to 800° C. at a rate of 5° C./h and held at the temperature for 5 h, cooled to 550° C. at the a of 5° C./h and held at the temperature for 5 h, and then air-cooled.

Test result: The trial-prepared Alloy 706 VAR ingot with the diameter of 1050 mm and the weight of 15.5 tons is free from hot cracking or metallurgical defects such as black and white freckles. The composition of the head and tail of the steel ingot is tested, and the result shows that there is no apparent burning loss of Al and Ti at the head and the tail, with 0.27% Al element at the head, 0.24% Al at the tail, 1.68% Ti at the head and 1.78% Ti at the tail. The second VAR ingot with the diameter of 1050 mm is diffusion annealed by homogenizing at high temperature, then polished and forged to prepare a bar. Upon non-destructive examination, it shows that there is no abnormal signal at the site where the electrode is exchanged, indicating that the second VAR can effectively address metallurgical quality defects suffered at the site of the Alloy 706 where the electrode is exchanged.

EXAMPLE 2

This example is used to illustrate a method for preparing Alloy 706 (a VAR ingot with a diameter of 1050 mm).

The target Alloy 706 had a composition of (by mass percentage):

C 0.011%, Cr 16.2%, Ni 42.5%, Nb 2.80%, Ti 1.57%, Al 0.15%, Si 0.02%, Mn 0.02%, P 0.008%, S 0.0004%, Co 0.01%, Mo 0.02%, B 0.003%, Cu 0.05%, Ca 0.001%, N 0.0045%, O 0.0025%, and the balance Fe.

The specific method for preparing the alloy was as follow.

Vacuum induction melting (VIM): According to the requirements of composition of the designed alloy, recycled material accounting for 50% of the elements needed for alloy of unit weight was weighed, and fresh metal accounting for the rest of the weight was weighed. A 12-ton VIM furnace was adopted, with an upper melting temperature limit being 1550° C. After melting down, the composition of molten steel was detected, and the molten steel was controlled to contain approximately 2.90 wt % Nb, approximately 1.62 wt % Ti, and approximately 0.20 wt % Al by adding fresh metals. Refining was carried out under electromagnetic stirring at 1480° C. for 40 min, and tapping was conducted at a temperature of 1500° C. The molten steel was poured in two steps, followed by furnace cooling for 4 h and demoulding to obtain two VIM ingots with a diameter of 820 mm and a weight of 12 tons, which were directly annealed. An annealing furnace was pre-heated to 650° C., heated to 900° C. at a rate of 25° C./h and held at the temperature for 24 h, cooled to 700° C. at a rate of 15° C./h and held at the temperature for 10 h, and then air-cooled.

The annealed VIM ingots were polished and flattened at the head and the tails to prepare electroslag electrodes.

Electroslag remelting (ESR): A crystallizer with a diameter of 1100 mm was adopted and a quaternary ($CaF_2$—$CaO$—$Al_2O_3$—$TiO_2$) slag system specifically having a composition of, by weight, 64% $CaF_2$, 15% CaO, 15% $Al_2O_3$, and 6% $TiO_2$ was adopted. A steady-state melting rate was 10 kg/min. During smelting, Ar at 0.2 bar pressure was introduced for protection, which prevents the molten steel from contacting with oxygen and nitrogen in the air. Before exchanging the electrode, when the weight of the remained first electrode was 500 kg, the melting rate was increased by 0.55 kg/min to 15 kg/min on the basis of the steady-state melting rate by adjusting input power and a voltage and was held until the electrode exchanging began. Smelting parameters during exchanging the electrode remained the same as those before exchanging the electrode, and the time for exchanging did not exceed 2 min. After exchanging the electrode, when 200 kg of a second electrode was melted, the melting rate was decreased by a slope of 0.75 kg/min to 10 kg/min by adjusting the input power and the voltage, and hot topping was carried out when the weight of the remained second electrode was 500 kg.

After ESR, an ESR ingot was water cooled in a water-cooled crystallizer in the furnace for 4 h, and within 0.5 h after demoulding, transferred to an annealing furnace for stress-relief annealing. The annealing furnace was pre-heated to 450° C. and held at the temperature for 24 h, heated to 650° C. at a rate of 15° C./h and held at the temperature for 4 h, heated to 950° C. at a rate of 25° C./h and held at the temperature for 12 h, cooled to 600° C. at a rate of 15° C./h and held at the temperature for 12 h, and then air-cooled.

Diffusion annealing ESR ingot at high temperature: The ESR ingot was loaded into the furnace at the temperature of 550° C. or below and held at the temperature for 4 h, heated to 950° C. at a rate of 10° C./h, heated to 1100° C. at the rate of 15° C./h and held at the temperature for 12 h, heated to 1190° C. at a rate of 20° C./h and held at the temperature for 48 h, cooled down to 850° C. at the rate of 15° C./h and held at the temperature for 24 h, and then air cooled.

Forging the electrode: The ESR ingot with the diameter of 1100 mm was heated to 1150° C. for 10 h before forging. A free forging was performed on a 3500-ton high-speed forging press by stretching in one direction, in which reduction per pass in one direction was controlled to be 25 mm, and the final forging temperature was 900° C. Finally, the ESR ingot was polished and flattened at the head and the tail to provide a primary consumable electrode with a diameter of 820 mm for use in a first VAR.

First VAR: A crystallizer with a diameter of 920 mm was adopted, the first VAR was controlled by the melting rate, and a steady-state melting rate was controlled to be 5.5 kg/min; helium cooling was initiated when 1000 kg of the primary consumable electrode is melted; a current was reduced and the melting rate was adjusted to 4.0 kg/min when the weight of the remained primary consumable electrode is 2000 kg; and hot topping controlled by the current was carried out when the weight of the remained primary consumable electrode is 500 kg. The steel ingot was polished and flattened at the head and the tail to provide a first VAR ingot with a diameter of 900 mm for use in a second VAR.

Second VAR: A crystallizer with a diameter of 1050 mm was adopted, the second VAR was controlled by the melting rate, and a steady-state melting rate was controlled to be 6.5 kg/min; helium cooling was initiated when 1500 kg of the first VAR ingot is melted;, the current was reduced and the melting rate was adjusted to 6.0 kg/min when the weight of the remained first VAR ingot is 2500 kg; and hot topping controlled by the current was carried out when the weight of the remained first VAR ingot is 800 kg. After the second VAR, the steel ingot was vacuum-cooled for 3 h and transferred to the annealing furnace for stress-relief annealing within 2 h after demoulding, which prevents the cracking of the steel ingot after demoulding. The annealing furnace was pre-heated to 450° C. and held at the temperature for 8 h for achieving homogeneous temperature distribution, heated to 850° C. at a rate of 10° C./h and held at the temperature for 24 h, cooled to 600° C. at a rate of 15° C./h and held at the temperature for 12 h, and then air-cooled.

During the second VAR, when the smelting proceeded to the site where the electrode is exchanged, fluctuation of the following key melting parameters occurred: fluctuation of current exceeded ±1000 A, fluctuation of voltage exceeded ±2V, and fluctuation of melting rate exceeded ±0.6 kg/min. This indicated that, the second VAR during smelting was still unstable, and the metallurgical defects at the site where the electrode is exchanged were transferred to the second VAR ingot, therefore a third VAR was required.

Diffusion annealing second VAR ingot at high temperature: The second VAR ingot was loaded into the furnace at the temperature of 550° C. or below and held at the temperature for 4 h, heated to 950° C. at a rate of 10° C./h, heated to 1100° C. at a rate of 15° C./h and held at the temperature for 12 h, heated to 1190° C. at a rate of 20° C./h and held at the temperature for 48 h, cooled down to 850° C. at the a of 15° C./h and held at the temperature for 24 h, and then air cooled.

Forging the electrode: The second VAR ingot with the diameter of 1050 mm was heated to 1150° C. for 10 h before forging. A free forging was performed on the 3500-ton high-speed forging press by stretching in one direction, in which reduction per pass in one direction was controlled to be 25 mm, and the final forging temperature was 900° C. Finally, the steel ingot was polished and flattened at the head and the tail to provide a tertiary consumable electrode with a diameter of 820 mm for use in a third VAR.

Third VAR: A crystallizer with a diameter of 1050 mm was adopted, the third VAR was controlled by the melting rate, and a steady-state melting rate was controlled to be 6.5 kg/min; helium cooling was initiated when 1500 kg of the VAR ingot is melted; the current was reduced and the melting rate was adjusted to 6.0 kg/min when the weight of the remained VAR ingot was 2500 kg; and hot topping controlled by the current was carried out when the weight of the remained VAR ingot was 800 kg. After the third VAR, the steel ingot was vacuum-cooled for 3 h and transferred to the annealing furnace for stress-relief annealing within 2 h, which prevents the steel ingot from cracking after demoulding. The annealing furnace was pre-heated to 450° C. and held at the temperature for 8 h for achieving homogeneous temperature distribution, heated to 850° C. at a rate of 10° C./h and held at the temperature for 24 h, cooled to 600° C. at a rate of 15° C./h and held at the temperature for 12 h, and then air-cooled.

Test result: The trial-prepared Alloy 706 VAR ingot with the diameter of 1050 mm and the weight of 16.2 tons is free from hot cracking or metallurgical defects such as black and white freckles. The composition at the head and tail of the steel ingot is tested, and the result shows that the there is no apparent burning loss of Al and Ti at the head and the tail, with 0.17% Al element at the head, 0.12% Al at the tail, 1.65% Ti at the head and 1.47% Ti at the tail. The third VAR ingot with the diameter of 1050 mm is diffusion annealed by homogenizing at high temperature, then polished and forged to prepare a bar. Upon non-destructive examination, it shows that there is no abnormal signal at the site where the electrode is exchanged, indicating that the third VAR can effectively address the metallurgical quality defects suffered at the site of the Alloy 706 where the electrode is exchanged.

EXAMPLE 3

This example is used to illustrate a method for preparing Alloy 718 (a consumable ingot with a diameter of 1050 mm).

The target Alloy 718 had a composition of (by weight): C 0.015%, Cr 18.5%, Ni 53.5%, Nb 5.05%, Ti 0.92%, Al 0.55%, Si 0.04%, Mn 0.05%, P 0.006%, S 0.0008%, Co 0.02%, Mo 2.95%, B 0.004%, Cu 0.05%, Ca 0.001%, N 0.0048%, O 0.0024%, and the balance Fe.

The specific method for preparing the alloy was as follow.

Vacuum induction melting (VIM): According to the requirements of composition of the designed alloy, recycled material accounting for 40% of the elements needed for alloy of unit weight was weighed, and fresh metals accounting for the rest of the weight were weighed. A 12-ton VIM furnace was adopted, with an upper melting temperature limit being 1550° C. After melting down, the composition of molten steel was detected, and the molten steel was controlled to contain approximately 5.08 wt % Nb, approximately 0.97 wt % Ti, and approximately 0.60 wt % Al by adding fresh metals. Refining was carried out under electromagnetic stirring at 1480° C. for 40min, and tapping was conducted at a temperature of 1500° C. The molten steel was poured in two steps, followed by furnace cooling for 6 h and demoulding to obtain two VIM ingots with a diameter of 820 mm and a weight of 12 tons which were directly annealed. An annealing furnace was pre-heated to 800° C., heated to 1000° C. at a rate of 45° C./h and held at the temperature for 32 h, cooled to 780° C. at a rate of 35° C./h and held at the temperature for 32 h, and then air-cooled.

The annealed VIM ingots were polished and flattened at the head and the tail to prepare electroslag electrodes.

Electroslag remelting (ESR): A crystallizer with a diameter of 1100 mm was adopted and a quaternary ($CaF_2$—$CaO$—$Al_2O_3$—$TiO_2$) slag system having a composition of, by weight, 75% $CaF_2$, 25% CaO, 10% $Al_2O_3$, and 1% $TiO_2$ was adopted. A steady-state melting rate was 55 kg/min. During smelting, Ar at 0.2 bar pressure was introduced for protection, which prevents the molten steel from contacting with oxygen and nitrogen in the air. Before exchanging the electrode, when the weight of a remained first electrode was 1000 kg, the melting rate was increased by 2 kg/min to 12 kg/min on the basis of the steady-state melting rate by adjusting input power and a voltage and was held until the electrode exchanging began. Smelting parameters during exchanging the electrode remained the same as those before exchanging the electrode, and the time for exchanging did not exceed 2 min. After exchanging the electrode, when 500 kg of a second electrode was melted, the melting rate was decreased by a slope of 2 kg/min to 15 kg/min by adjusting the input power and the voltage, and hot topping was carried out when the weight of the remained second electrode was 600 kg.

After ESR, an ESR ingot was water cooled in a water-cooled crystallizer in the furnace for 4 h, and within 1 h after demoulding, transferred to an annealing furnace for stress-relief annealing. The annealing furnace was pre-heated to 550° C. and held at the temperature for 32 h, heated to 750° C. at a rate of 25° C./h and held at the temperature for 4 h, heated to 1000° C. at a rate of 30° C./h and held at the temperature for 32 h, cooled to 750° C. at the rate of 35° C./h and held at the temperature for 32 h, and then air-cooled.

Diffusion annealing ESR ingot at high temperature: The ESR ingot was loaded into the furnace at the temperature of 550° C. or below and held at the temperature for 4 h, heated to 1000° C. at a rate of 5° C./h, heated to 1150° C. at the rate of 25° C./h and held at the temperature for 32 h, heated to 1250° C. at a rate of 25° C./h and held at the temperature for 72 h, cooled down to 950° C. at a rate of 35° C./h and held at the temperature for 32 h, and then air cooled.

Forging the electrode: The ESR ingot with the diameter of 1100 mm was heated to 1150° C. for 12 h before forging. A free forging was performed on a 3500-ton high-speed forging press by stretching in one direction, in which reduction per pass in one direction was controlled to be 25 mm, and the finishing forging temperature was 1000° C. Finally, the ESR ingot was polished and flattened at the head and the tail to provide a primary consumable electrode with a diameter of 820 mm for use in a first VAR.

First VAR: A crystallizer with a diameter of 920 mm was adopted, the first VAR was controlled by the melting rate, and a steady-state melting rate was controlled to be 7.5 kg/min; helium cooling was initiated when 2000 kg of the primary consumable electrode is melted; a current was reduced and the melting rate was adjusted to 7.0 kg/min when the weight of the remained primary consumable electrode is 1000 kg; and the hot topping which is controlled by the current was carried out when the weight of the remained primary consumable electrode is 1000 kg. The steel ingot was polished and flattened at the head and at the tail to provide a first VAR ingot with a diameter of 900 mm for use in a second VAR.

Second VAR: A crystallizer with a diameter of 1050 mm was adopted, the second VAR was controlled by the melting rate, and a steady-state melting rate was controlled to be 8.5 kg/min; helium cooling was initiated when 3000 kg of the first VAR ingot is melted; the current was reduced and the melting rate was adjusted to 7.5 kg/min when the weight of the remained first VAR ingot is 5500 kg; and hot topping controlled by the current was carried out when the weight of the remained first VAR ingot is 1500 kg. After the second VAR, the steel ingot was vacuum-cooled for 3 h and transferred to the annealing furnace for stress-relief annealing within 2 h, which prevents the steel ingot from cracking after demoulding. The annealing furnace was pre-heated to 750° C. and held at the temperature for 32 h for achieving homogeneous temperature distribution, heated to 1000° C. at a rate of 50° C./h and held at the temperature for 32 h, cooled to 750° C. at the rate of 35° C./h and held at the temperature for 32 h, and then air-cooled.

Test result: The trial-prepared Alloy 718 VAR ingot with the diameter of 1050 mm and the weight of 15 tons is free from hot cracking or metallurgical defects such as black and white freckles. The composition of the steel ingot at the head and the tail is tested, and the result shows that there is no apparent burning loss of Al and Ti at the head and the tail, with 0.60% Al element at the head, 0.48% Al at the tail, 0.87% Ti at the head and 0.98% Ti at the tail. The second VAR ingot with the diameter of 1050 mm is diffusion annealed by homogenizing at high temperature, then polished and forged to prepare a bar. Upon non-destructive examination, it shows that there is no abnormal signal at the site where the electrode is exchanged, indicating that the second VAR can effectively address the metallurgical quality defects suffered at the site of the Alloy 718 where the electrode is exchanged.

Comparative Example 1

Comparative Example 1 is used to illustrate a method for preparing Alloy 706 (a consumable ingot with a diameter of 920 mm) by adopting a triple-melt process.

The composition of the target Alloy 706 is the same as that of Alloy 706 in Example one (by mass percentage):

C 0.018%, Cr 15.8%, Ni 41.5%, Nb 3.01%, Ti 1.72%, Al 0.25%, Si 0.02%, Mn 0.01%, P 0.006%, S 0.0006%, Co 0.02%, Mo 0.01%, B 0.004%, Cu 0.02%, Ca 0.004%, N 0.005%, O 0.002%, and the balance Fe.

The specific method for preparing the alloy was as follow.

Vacuum induction melting (VIM): According to the requirements of composition of the designed alloy, recycled material accounting for 40% of the elements needed for alloy of unit weight was weighed, and fresh metals accounting for the rest of the weight were weighed. A 12-ton VIM furnace was adopted to obtain two VIM ingots with a diameter of 820 mm having a weight of 12 tons, in which an upper melting temperature limit was 1550° C. After melting down, the composition of molten steel was detected, and the molten steel was controlled to contain approximately 3.10 wt % Nb, approximately 1.82 wt % Ti, and approximately 0.35 wt % Al by adding fresh metals. Refining was carried out under electromagnetic stirring at 1480° C. for 40 min, and tapping was conducted at a temperature of 1500° C. After pouring, furnace cooling was carried out for 4 h and demoulding was carried out to obtain VIM ingots which were directly annealed. The annealing furnace was pre-heated to 650° C., heated to 900° C. at a rate of 25° C./h and held at the temperature for 24 h, cooled to 600° C. at a rate of 15° C./h and held at the temperature for 10 h, and then air-cooled.

The annealed VIM ingots were polished and flattened at the head and the tail to prepare electroslag electrodes.

Electroslag remelting (ESR): A crystallizer with a diameter of 1100 mm was adopted and a tertiary ($CaF_2$—CaO—$Al_2O_3$) slag system having a composition of 70% $CaF_2$, 15% CaO, and 15% $Al_2O_3$ was adopted. A steady-state melting rate was 10 kg/min. During smelting, Ar at 0.2 bar pressure was introduced for protection, which prevents the molten steel from contacting with oxygen and nitrogen in the air. Before exchanging the electrode, when the weight of a remained first electrode was 600 kg, the melting rate was increased by 0.55 kg/min to 15 kg/min on the basis of the steady-state melting rate by adjusting input power and a voltage and was held until the electrode exchanging began. Smelting parameters during exchanging the electrode were the same as those before exchanging the electrode, and the time for exchanging did not exceed 2 min. After exchanging the electrode, when 200 kg of a second electrode was melted, the melting rate was decreased by 0.75 kg/min to 10 kg/min by adjusting the input power and the voltage, and hot topping was carried out when the weight of the remained second electrode was 500 kg.

After ESR, an ESR ingot was water cooled in a water-cooled crystallizer in the furnace for 4 h, and within 0.5 h after demoulding, transferred to an annealing furnace for stress-relief annealing. The annealing furnace was pre-heated to 450° C. and held at the temperature for 24 h, heated to 650° C. at a rate of 15° C./h and held at the temperature for 4 h, heated to 950° C. at a rate of 25° C./h and held at the temperature for 12 h, cooled to 600° C. at a rate of 15° C./h and held at the temperature for 12 h, and then air-cooled.

Diffusion annealing ESR ingot at high temperature: The ESR ingot was loaded into the furnace at the temperature of 550° C. or below and held at the temperature for 4 h, heated to 950° C. at a rate of 10° C./h, heated to 1100° C. at the rate of 15° C./h and held at the temperature for 12 h, heated to 1190° C. at a rate of 20° C./h and held at the temperature for 48 h, cooled down to 850° C. at the rate of 15° C./h and held at the temperature for 24 h, and then air cooled.

Forging the electrode: The ESR ingot with the diameter of 1100 mm was heated to 1150° C. for 10 h Before forging. A free forging was performed on a 3500-ton high-speed forging press was adopted for stretching in one direction, in which reduction per pass in one direction was controlled to be 25 mm, and a finishing forging temperature was 900° C. Finally, the ESR ingot was polished and flattened at the head and the tail to prepare a consumable electrode with a diameter of 820 mm.

VAR: A crystallizer with a diameter of 920 mm was adopted, the VAR was controlled by the melting rate, and a steady-state melting rate was controlled to be 5.5 kg/min; helium cooling was initiated when 1000 kg of the consumable electrode is melted; a current was reduced and the melting rate was adjusted to 4.0 kg/min when the weight of the remained consumable electrode is 2000 kg; and the hot topping controlled by the current was carried out when the weight of the remained consumable electrode is 500 kg. After the VAR, the steel ingot was vacuum-cooled for 3 h and transferred to the annealing furnace for stress-relief annealing within 2 h after demoulding, which prevents the steel ingot from cracking after demoulding. The annealing furnace was pre-heated to 450° C. and held at the temperature for 8 h for keeping homogeneous, heated to 850° C. at a rate of 10° C./h and held at the temperature for 24 h, cooled to 600° C. at a rate of 15° C./h and held at the temperature for 12 h, and then air-cooled.

Test result: The Alloy 706 VAR ingot with the diameter of 920 mm and the weight of 15 tons prepared by the triple-melt process is free from hot cracking. The composition the steel ingot at the head and the tail is tested, and the result shows that there is apparent burning loss of Al and Ti at the head and the tail, with 0.29% Al element at the head, 0.19% Al at the tail, 1.62% Ti at the head and 1.80% Ti at the tail. The second VAR ingot with the diameter of 1050 mm is diffusion annealed by homogenizing at high temperature, then polished and forged to prepare a bar. Upon non-destructive examination, it shows that there is abnormal signal at the site where the electrode is exchanged, and obvious black freckles are found at the site where the electrode is exchanged by dissection.

Comparative Example 2: Consumable Ingot of Alloy 706 Having a Diameter of 1050 mm Comparative Example 2 is used to illustrate a method for preparing Alloy 706 by adopting a triple-melt process (a VAR ingot with a diameter of 1050 mm).

The composition of the desired Alloy 706 is the same as that of Alloy 706 in example two (by mass percentage):

C 0.011%, Cr 16.2%, Ni 42.5%, Nb 2.80%, Ti 1.57%, Al 0.15%, Si 0.02%, Mn 0.02%, P 0.008%, S 0.0004%, Co 0.01%, Mo 0.02%, B 0.003%, Cu 0.05%, Ca 0.001%, N 0.0045%, O 0.0025%, and the balance Fe.

The specific method for preparing the alloy was as follow.

Vacuum induction melting (VIM): According to the requirements of composition of the designed alloy, recycled material, accounting for 50% of the elements needed for alloy of unit weight, was weighed, and fresh metals, accounting for the rest of the weight, were weighed. A 12-ton VIM furnace was adopted to obtain two VIM ingots with a diameter of 820 mm having a weight of 12 tons, in which an upper melting temperature limit was 1550° C. After melting down, the composition of molten steel was detected, and by adding fresh metals, the molten steel was controlled to contain approximately 3.10 wt % Nb, approximately 1.72 wt % Ti, and approximately 0.30 wt % Al. Refining was carried out under electromagnetic stirring at 1480° C. for 40 min, and tapping was conducted at a temperature of 1500° C. After pouring, furnace cooling was carried out for 4 h and demoulding was carried out to obtain VIM ingots which are directly annealed. An annealing furnace was pre-heated to 650° C., heated to 900° C. at a rate of 25° C./h and held at the temperature for 24 h, cooled to 600° C. at a rate of 15° C./h and held at the temperature for 10 h, and then air-cooled.

The annealed VIM ingots were polished and flattened at the heads and the tails to prepare electroslag electrodes.

Electroslag remelting (ESR): A crystallizer with a diameter of 1100 mm was adopted and a quaternary slag system specifically having a composition of, by weight, 64% $CaF_2$, 15% CaO, 15% $Al_2O_3$, and 6% $TiO_2$ was adopted. A steady-state melting rate was 10 kg/min. During smelting, Ar at 0.2 bar pressure was introduced for protection, which prevents the molten steel from contacting with oxygen and nitrogen in the air. Before exchanging the electrode, when the weight of a remained first electrode was 600 kg, the melting rate was increased by 0.55 kg/min to 15 kg/min on the basis of the steady-state melting rate by adjusting input power and a voltage and was held until the electrode exchanging began. Smelting parameters during exchanging the electrode were the same as those before exchanging the electrode, and the time for exchanging did not exceed 2 min. After exchanging the electrode, when a second electrode was melted 200 kg, the melting rate was decreased by a slope of 0.75 kg/min to 10 kg/min by adjusting the input power and the voltage, and hot topping was carried out when the weight of the remained second electrode was 500 kg.

After ESR, an ESR ingot was water cooled in a water-cooled crystallizer in the furnace for 4 h, and within 0.5 h after demoulding, transferred to an annealing furnace for stress-relief annealing. The annealing furnace was pre-heated to 450° C. and held at the temperature for 24 h, heated to 650° C. at a rate of 15° C./h and held at the temperature for 4 h, heated to 950° C. at a rate of 25° C./h and held at the temperature for 12 h, cooled to 600° C. at a rate of 15° C./h and held at the temperature for 12 h, and then air-cooled.

Diffusion annealing ESR ingot at high temperature: The ESR ingot was loaded into the furnace at the temperature of 550° C. or below and held at the temperature for 4 h, heated to 950° C. at a rate of 10° C./h, heated to 1100° C. at the rate of 15° C./h and held at the temperature for 12 h, heated to 1190° C. at a rate of 20° C./h and held at the temperature for 48 h, cooled down to 850° C. at the rate of 15° C./h and held at the temperature for 24 h, and then air cooled.

Forging the electrode: The ESR ingot with the diameter of 1100 mm was heated to 1150° C. for 10 h before forging. A free forging was performed on a 3500-ton high-speed forging press was adopted by stretching in one direction, in which reduction per pass in one direction was controlled to be 25 mm, and a finishing forging temperature was 900° C. Finally, the ESR ingot was polished and flattened at the head and the tail to provide a consumable electrode with a diameter of 820 mm.

VAR: A crystallizer with a diameter of 1050 mm was adopted, the VAR was controlled by the melting rate, and a steady-state melting rate was controlled to be 6.0 kg/min; helium cooling was initiated when 1500 kg of the consumable electrode is melted; a current was reduced and the melting rate was adjusted to 5.0 kg/min when the weight of the remained consumable electrode is 2500 kg; and the hot topping which is controlled by the current was carried out when the weight of the remained consumable electrode is 800 kg. After the VAR, the steel ingot was vacuum-cooled for 3 h and transferred to the annealing furnace for stress-relief annealing within 2 h, which prevents the steel ingot from cracking after demoulding. The annealing furnace was pre-heated to 450° C. and held at the temperature for 8 h for keeping homogeneous, heated to 850° C. at a rate of 10° C./h and held at the temperature for 24 h, cooled to 600° C. at a rate of 15° C./h and held at the temperature for 12 h, and then air cooled.

Test result: The Alloy 706 VAR ingot with the diameter of 1050 mm having the weight of 15.8 tons prepared by the triple-melt process is free from hot cracking. The composition of the steel ingot at the head and tail is tested, and the result shows that there is no apparent buring loss of Al and Ti at the head and the tail, with 0.16% Al element at the head, 0.12% Al at the tail, 1.65% Ti at the head and 1.50% Ti at the tail. The second VAR ingot with the diameter of 1050 mm is diffusion annealed by homogenizing at high temperature, then polished and forged to prepare a bar. Upon non-destructive examination, it shows that there is abnormal signal at the site where the electrode is exchanged, and obvious black freckles are found at the site where the electrode is exchanged by dissection.

What is provided above is merely some preferred embodiments of this application. The scope of this application is not limited by the above embodiments. Therefore, some improvements and modifications can be made by those skilled in the art without departing from the principle of this application, and should be considered to fall within the scope of this application.

What is claimed is:

1. A smelting process of a high-Nb superalloy ingot, comprising the following steps of:

vacuum induction melting (VIM): conducting VIM on at least one of pure metal raw material or recycled material as raw material, and pouring to form a plurality of consumable VIM ingots, wherein the plurality of consumable VIM ingots have a same composition; and electroslag remelting (ESR): preparing a same number of electroslag electrodes as that of the plurality of consumable VIM ingots; and electroslag remelting all the electroslag electrodes under protection of argon; cooling down and demoulding to obtain an ESR ingot; conducting consumable vacuum arc remelting (VAR) for a plurality of times: performing a first annealing and a second annealing on the ESR ingot and forging by stretching to a predetermined size to obtain a primary consumable electrode, in which the second annealing is performed at a temperature higher than that for performing the first annealing; and performing VAR at least twice by using the primary consumable electrode as starting material, in which a resulting VAR ingot obtained after each VAR is used as a consumable electrode to be used in a next VAR, with a diameter of the resulting VAR ingot being increased after each VAR until fluctuation of a melting rate during a last VAR falls within ±10% of a steady-state melting rate, and a VAR ingot obtained in the last VAR is used to prepare an ingot with a target diameter, wherein preparing the electroslag electrodes comprises directly stress-relieve annealing each of the plurality of consumable VIM ingot, in which a temperature is initially raised to 600-800° C., then raised to 800-1000° C. at a rate of 5-45° C./h, kept constant for 4-32 h, lowered to 600-800° C. at a rate of 1-35° C./h and kept constant for 4-32 h; air cooling; polishing; and flattening at a head and a tail to obtain the electroslag electrodes;

wherein a quaternary slag system having a composition of $CaF_2$—CaO—$Al_2O_3$—$TiO_2$ comprising 60-75 wt % $CaF_2$, 10-25 wt % CaO, 10-25 wt % $Al_2O_3$, and 1-10 wt % $TiO_2$ is employed;

the steady-state melting rate of the ESR is controlled to be 5-15 kg/min, before exchanging each of the electroslag electrodes, when a remaining weight of one electroslag electrode is 500 kg-1000 kg, the melting rate is increased by a slope of 0.5-2 kg/min to 12-25 kg/min on a basis of the steady-state melting rate and kept stable until the exchanging begins, during which smelting parameters remain the same as those before the exchanging and an exchanging time does not exceed 2 min; after the exchanging each of the electroslag electrodes, the melting rate is reduced by a slope of 0.5-2 kg/min to the steady-state melting rate of 5-15 kg/min for continuing the remelting when 100kg-500 kg of a next electroslag electrode is melted, and hot topping is carried out when a remaining weight of a last electroslag electrode is 200-600 kg; and after the ESR, the cooling down is carried out for 2-10 h and the demoulding is carried out to obtain the ESR ingot;

wherein in the step of VAR for a plurality of times, the performing the first annealing and the second annealing on the ESR ingot and the forging by stretching to the predetermined size to obtain the primary consumable electrode comprises the following steps of:

initiating the first annealing to the ESR ingot within 0.5-2 h after the demoulding, in which the temperature is initially raised to 300-550° C., kept constant for 12-32 h for achieving homogeneous temperature distribution, raised to 600-750° C. at a rate of 1-25° C./h, kept constant for 4-32 h, raised to 800-1000° C. at a rate of 5-35° C./h, kept constant for 4-32 h, lowered to 550-750° C. at a rate of 1-35° C./h, and kept constant for 4-32 h, followed by air cooling;

performing the second annealing on the ESR ingot after the first annealing, in which the temperature is raised to 800-1000° C. at a rate of 5-35° C./h, raised to 1050-1150° C. at a rate of 1-25° C./h, kept constant for 4-32 h, raised to 1150-1250° C. at a rate of 1-25° C./h, kept constant for 24-72 h, lowered to 800-950° C. at a rate of 1-35° C./h, and kept constant for 4-32 h, followed by air cooling;

forging the ESR ingot after the second annealing, in which the ESR ingot is heated to 1100-1180° C. for 4-12 h before the forging, and subjected to a free forging on a forging press of 3000 tons or above by stretching in one direction, in which a reduction per pass in one direction is 5-30 mm and a final forging temperature is in a range of 850-1000° C.; and polishing the ESR ingot stretched during the free forging and flattening at a head and a tail to obtain the primary consumable electrode.

2. The smelting process according to claim 1, wherein in the step of VIM, the raw material contains 2.8-5.5 wt % Nb, 0.2-1.0 wt % Al and 0.5-2.0 wt % Ti.

3. The smelting process according to claim 1, wherein in the step of VIM, the raw material is melted at a temperature of 1300-1550° C. until melting down, refined under electromagnetic stirring at 1350-1550° C. for 15-120 min, cooled for 1-10 h, and demoulded to obtain a VIM ingot; and the VIM process is performed for a plurality of times to obtain the plurality of consumable VIM ingots;

wherein in the step of VAR for the plurality of times, a first VAR and a second VAR comprise the following steps of: performing the first VAR at a steady-state melting rate of 3.5-7.5 kg/min; initiating helium cooling when 800-2000 kg of the primary consumable electrode is melted; decreasing a current and adjusting the melting rate to 3.0-7.0 kg/min when a weight of the remaining primary consumable electrode is 1500-5000 kg; and starting hot topping when the weight of the remaining primary consumable electrode is 200-1000 kg, thereby obtaining a first VAR ingot;

for the second VAR, first polishing the first VAR ingot, and flattening the first VAR ingot at a head and a tail to obtain a secondary consumable electrode;

performing the second VAR at a steady-state melting rate of 4.0-8.5 kg/min; initiating helium cooling when 1000-3000 kg of the secondary consumable electrode is melted; decreasing the current and adjusting the melting rate to 3.0-7.5 kg/min when a weight of the remaining secondary consumable electrode is 2000-5500 kg; and starting hot topping when the weight of the remaining secondary consumable electrode is 250-1500 kg; and after the second VAR, vacuum cooling for 1-8 h and then starting stress-relief annealing within 2 h, wherein the temperature is raised to 300-750° C., kept constant for 4-32 h for achieving homogeneous temperature distribution, raised to 800-1000° C. at a rate of 5-50° C./h, kept constant for 4-32 h, lowered to 550-750° C. at a rate of 1-35° C./h, and kept constant for 4-32 h, followed by air cooling.

4. The smelting process according to claim 3, wherein, when fluctuation of the melting rate during the second VAR is beyond ±10% of the steady-state melting rate, an obtained second VAR ingot is used to prepare a consumable electrode to be used for a next VAR by the same way as for preparing the primary consumable electrode, including the same first annealing, second annealing, and forging by stretching, and then the second VAR is repeated.

5. A high-Nb superalloy ingot prepared by the smelting process according to claim 1, wherein the high-Nb superalloy ingot is an Alloy 706 with a diameter of 800 mm or above, by mass percentage, having a chemical composition of:

C≤0.02%, Cr 15.5-16.5%, Ni 40.0-43.0%, Nb 2.8-3.2%, Ti 1.5-1.8%, Al 0.1-0.3%, Si≤0.10%, Mn≤0.20%, P≤0.015%, S≤0.0013%, Co≤0.30%, Mo≤0.20%, B≤0.006%, Cu≤0.30%, Ca≤0.005%, N≤0.006%, O≤0.005%, and Fe the balance.

6. A large-sized high-Nb superalloy ingot prepared by the smelting process according to claim 1, wherein the high-Nb superalloy ingot is an Alloy 718 with a diameter of 800 mm or above, by mass percentage, having a chemical composition of:

C 0.005-0.04%, Cr 17.0-19.0%, Ni 52.0-55.0%, Nb 4.9-5.5%, Ti 0.75-1.15%, Al 0.35-0.65%, Si≤0.10%, Mn≤0.15%, P≤0.008%, S≤0.002%, Co≤0.50%, Mo 2.8-3.3%, B≤0.006%, Cu≤0.10%, Ca≤0.005%, N≤0.01%, O≤0.003%, and Fe the balance.

* * * * *